US007172661B1

(12) United States Patent
Adar et al.

(10) Patent No.: US 7,172,661 B1
(45) Date of Patent: Feb. 6, 2007

(54) HIGH STRENGTH NICKEL-BASED AMORPHOUS ALLOY

(75) Inventors: Eliezer Adar, Sde Varburg (IL); Ehud Yaffe, Kibutz Yifat (IL)

(73) Assignee: Global Micro Wire Technologies Ltd., Even Yehuda (IL)

( * ) Notice: Subject to any disclaimer, the term of this patent is extended or adjusted under 35 U.S.C. 154(b) by 199 days.

(21) Appl. No.: 10/943,953

(22) Filed: Sep. 20, 2004

Related U.S. Application Data

(60) Provisional application No. 60/508,882, filed on Oct. 7, 2003.

(51) Int. Cl.
*C22C 45/04* (2006.01)

(52) U.S. Cl. ..... 148/403; 164/91; 420/443; 420/588

(58) Field of Classification Search ..... 148/403, 148/426, 427; 420/443, 588
See application file for complete search history.

(56) References Cited

U.S. PATENT DOCUMENTS

| | | | | |
|---|---|---|---|---|
| 4,668,310 | A * | 5/1987 | Kudo et al. | 148/304 |
| 4,692,305 | A * | 9/1987 | Rangaswamy et al. | 420/436 |
| 5,376,191 | A * | 12/1994 | Roman et al. | 148/403 |
| 6,325,868 | B1 * | 12/2001 | Kim et al. | 148/403 |
| 6,623,566 | B1 * | 9/2003 | Senkov et al. | 148/121 |

FOREIGN PATENT DOCUMENTS

JP 57-082454 A * 5/1982

* cited by examiner

*Primary Examiner*—George Wyszomierski
(74) *Attorney, Agent, or Firm*—Oblon, Spivak, McClelland, Maier & Neustadt, P.C.

(57) ABSTRACT

A high precision alloy, and in particular, high-strength nickel-based amorphous compositions for fabrication of glass-coated microwires.

6 Claims, 1 Drawing Sheet

HIGH STRENGTH NICKEL-BASED AMORPHOUS ALLOY

CROSS-REFERENCE TO RELATED APPLICATIONS

The present application is a continuation of provisional U.S. application Ser. No. 60/508,882 filed on Oct. 7, 2003, the entire contents of which are incorporated herein by reference.

BACKGROUND OF THE INVENTION

1. Field of the Invention

This invention relates to the preparation of high precision alloy, and in particular, high-strength nickel-based amorphous compositions for fabrication of glass-coated microwires.

2. Description of the Related Art

It has been the tendency in modern technologies to demand new materials and processes for their production from material engineering. Strengthening of the structural materials by reinforcing them with high strength fibers or wires is one of the problems of the material engineering in the production of elements and structures operating under harsh environment and exploitation conditions.

The modern methods for strengthening of metals and alloys employ various treatments, e.g., strain hardening, thermal and thermal-mechanical treatment, precipitation hardening, martensite reinforcement, etc. Such treatments allow to obtain, for example, steels and alloys having tensile strength in the range of 1000–3000 MPa. In particular, the forming in the metal matrix such strengthening phases as δ-phase (Ni—Mo), σ-phase and ρ-phase ($Cr_{18}Mo_{42}Ni_{40}$) has a great potential for obtaining high strength materials.

Known techniques for casting microwires in glass insulation enable to form an amorphous homogeneous structure and the strengthening phases in the material, and thereby increase the strength characteristic up to 3000–4500 MPa. The high strength is, inter alia, attained by providing a high degree of the melt oversaturation by applying reinforcing components and "freezing" the alloy in this condition at quenching the material from the liquid phase with the cooling rate of up to $3\times10^6$ K/s.

According to the microwire casting techniques, a glass tubing containing the desired metal batch is heated to a temperature sufficient to melt the metal and soften the glass. In general, the heating is obtained via electromagnetic induction for melting the metal which, in turn, softens the glass. The outer glass shell is then drawn out as fine as desired. As a result, two coaxial flows arise: one of the melted metal in the center and another of softened glass around the metal one. After leaving the heating zone, both flows pass through a water stream, for cooling and solidifying. The result is a continuous microwire with the metal being continuously cast as a core covered with a glass coating.

U.S. Pat. No. 6,325,868 discloses a nickel-based amorphous alloy having a superior amorphous phase-forming ability. This alloy contains nickel, zirconium and titanium as main constituent elements along with additional elements, such as Si or P. Also, at least one kind of element selected from the group consisting of V, Cr, Mn, Cu, Co, W, Sn, Mo, Y, C, B, P, Al can be added to the alloy composition in the range of content of 2 to 15 atomic %.

One of the drawbacks of this alloy is that it contains a rather large amount of such elements as Ti and Zr, i.e., from 40 to 60%, which are easy oxidizable metals. In this case the alloy drop can turn into oxide during the microwire casting process and prevent microwire manufacture.

U.S. Pat. No. 4,668,310 discloses amorphous alloys having high strength and hardness. The general composition formula of these alloys is $T_aX_bZ_cM_d$, where T is at least one of Fe, Co and Ni;

X is at least one of Zr, Ti, Hf and Y;

Z is at least one of B, C, Si, Al, Ge, Bi, S, P;

M is at least one of Mo, Cr, W, V, Nb, Ta, Cu, Mn, Zn, Sb, Sn, Be, Mg, Pd, Pt, Ru, Os, Rh, Ir, Ce, La, Pr, Nd, Sm, Eu, Gd, Th, Dy; and a is 70–98 atomic %, b is from 5 to 30 atomic %, c is from 0 to 0.5 atomic %, and d is not more than 20 atomic %, and sum of a, b, c, and d is 100 atomic %.

One of the disadvantages of this alloy is in the fact that it is not suitable for microwire casting, owing to the deficiency of such elements as B and Si (less than 0.5%). For such contents of B and Si, the wetting ability of silica-boride glasses by the metal melt is not sufficient for providing a mass microwire manufacturing process. Moreover, the content of such elements as Cr and Mo does not exceed 20%, that prevents from forming the high strength ρ-phase.

USSR inventor's certificate No. 428,028 discloses an alloy for casting of the microwire. This alloy was developed by taking into account the specific conditions of physical and chemical interaction between the metal melt and glass during microwire casting process. Alloy has the following content, by weight %:

Cr: 10.0–20.0%,

Mo: 25.0–40.0%,

Si: 0.2–3.0%,

B: 0.1–1.2%,

Ni: the base.

The tensile strength of a microwire obtained from this alloy is between 3000 and 4500 MPa.

One of the disadvantages of utilization of this alloy is that it is not suitable for preparing long continuous microwire lines (more than 100 m) during the microwire casting process. Moreover, the obtained microwire has a large dispersal of diameter along its length (up to +/−20%). These drawbacks are associated, inter alia, with insufficient purification of the alloy mainly from entrapped gas and other non-metallic inclusions. These disadvantages limit and sometime even restrict practical utilization of the microwires obtained from this alloy, especially when the strengthening of structure is achieved as a result of the winding of the reinforced microwire. Likewise, due to the lack of an amorphizer in the alloy composition, an amorphous structure of the alloy cannot be achieved, that prevents from obtaining an amorphous homogeneous alloy.

USSR inventor's certificate No. 662611 discloses an alloy having the following composition, by weight %:

Cr: 18–40%,

Mo: 30–40%,

Si: 0.2–3.0%,

B: 0.1–1.2%,

Zr: 0.3–1.0%,

Ni: the base.

The main disadvantage of this alloy, as well as in the above case, is the impossibility of fabrication of the microwire having long continuous length and small dispersal of the wire's diameter along its length. Notwithstanding the alloy composition includes such effective amorphizer as Zr, it is still difficult to provide the amorphous structure, because the amorphization for such alloy can be only achieved when the content of Zr is not less than 1.2%.

SUMMARY OF THE INVENTION

Thus, despite the extensive prior art in the area of glass-covered microwires, there is still a need for further improvements of the alloy's content. It is desirable that the microwire obtained by a casting production process would have very high tensile strength and stable physical and mechanical properties along its length. It is also desirable to produce long continuous microwires having the length of 1000 m and more. Such microwires with reproductive properties can be used for reinforcing structural materials.

The present invention satisfies the aforementioned need by providing a novel Ni-based amorphous alloy, containing Cr, Mo, Si, B and Zr along with Y and at least one additional rare-earth element selected from Ce, La, Nd and Pr.

According to one embodiment of the invention, the amorphous Ni-based alloy obtained by microwire casting technique has the following composition, by weight %:

10.0 to 40.0% of Cr;

25.0 to 42.0% of Mo;

0.6 to 6.0% of Si;

0.3 to 3.0% of B;

1.2 to 5.0% of Zr;

0.1–1.8% of at least one element selected from the rare-earth group including: Ce, La, Nd and Pr;

0.1–1.5% of Y, and

Ni is the balance, where Si and B must be in ratio of Si:B=2:1 for providing a stable casting process.

According to another embodiment of the present invention, a Ni-based amorphous alloy is provided for use in casting of microwires with aluminum-borosilicate glass insulation. This alloy additionally contains 0.6–5.0 weight % of Al.

It should be noted when more than 5.0 weight % of Al is in the alloy, a large amount of oxides of the type of $Al_2O_3$ is formed at the microwire casting process. These oxides can lead to interruption of the casting process, when they are in the capillary formed by the glass coating. On the other hand, when less than 0.6 weight % of Al is in the alloy, the required wetting of the glass by the metal is not achieved, that also results in the interruption of the casting process and inability to manufacture long wires with stable properties.

There has thus been outlined, rather broadly, the more important features of the invention in order that the detailed description thereof that follows hereinafter may be better understood. Additional details and advantages of the invention will be set forth in the detailed description, and in part will be appreciated from the description, or may be learned by practice of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

In order to understand the invention and to see how it may be carried out in practice, a preferred embodiment will now be described, by way of non-limiting example only, with reference to the accompanying drawing, in which.

DETAILED DESCRIPTION OF THE PREFERRED EMBODIMENTS

Figure 1:
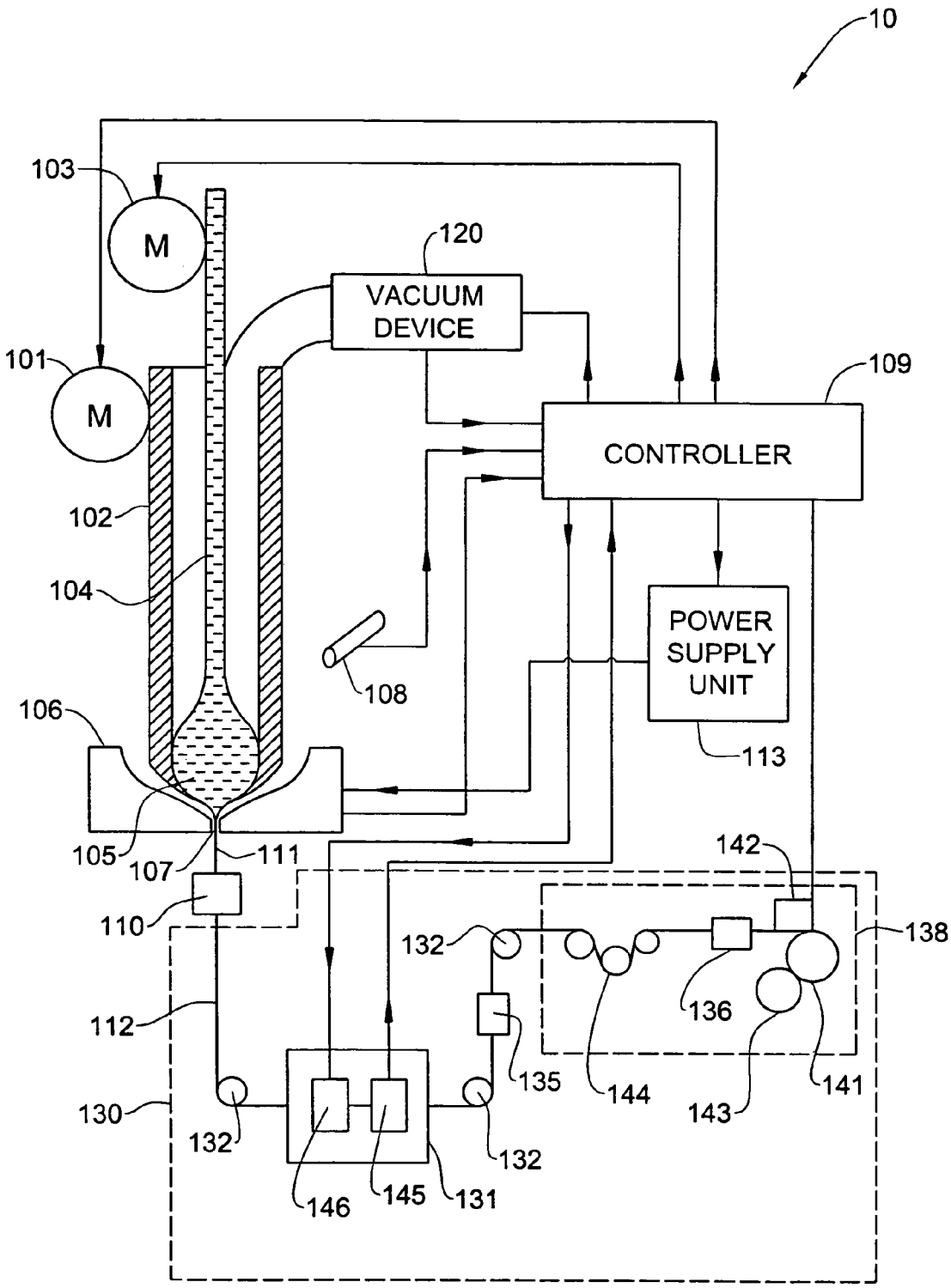
FIG. 1 is a schematic illustration of the system for mass manufacture of continuous lengths of glass-coated microwire, according to one embodiment of the invention.

Referring now to the drawings, wherein like reference numerals designate identical or corresponding parts throughout the several views.

The principles and operation of the process and apparatus according to the present invention may be better understood with reference to the drawings and the accompanying description, wherein like reference numerals have been used throughout to designate identical elements. It is understood that these drawings are given for illustrative purposes only and are not meant to be limiting.

According to one embodiment of the invention, the development of the optimal alloy composition is carried out on the base of Ni—Cr—Mo system having the most strength structure corresponding to ρ-phase. A relationship between the components of the Ni—Cr—Mo system, corresponding to the ρ-phase is the following, by weight %:

Ni: the balance;

Cr: 10.0–18.0%; and

Mo: 25.0–28.0%.

This ratio of the elements corresponds to the equilibrium composition for the alloy. When the alloy is at the non-equilibrium state, there is an oversaturation, thus the concentration ratio for the ρ-phase enlarges, accordingly. The enlarged ratio of the components in the ρ-phase corresponds to the oversaturation that can be obtained under quenching at the rate of about $10^6$ K/s. An example of the enlarged ratio of the components that can be used for casting microwires is:

Cr: 10.0–40.0%,

Mo: 25.0–42.0%,

Ni: as the balance.

The microwires fabricated from this alloy have the tensile strength of about 4600–4800 MPa. However, because of the low wetting between the glass and melt, being at the ρ-phase state, a production of the microwire with length more than 1 m cannot be attained. When the amount of Cr is less than 10% and Mo is less than 25% or amount of Cr more than 40% and Mo more than 42%, the ρ-phase is not formed, thus the tensile strength of this alloy is decreased up to 300–700 MPa.

According to another embodiment of the invention, in order to enhance the wetting of the borosilicate glasses by the melt of the alloy, such elements as Si and B in the amounts of 0.6–6.0 weight % and 0.3–3.0 weight %, respectively, are introduced into the Ni—Cr—Mo system. It was found that the best result of the wetting, and therefore a significant increase of length of the continuous microwires is attained when the ratio between Si and B is about Si:B=2. The effect of the wetting enhancement is obtained when the content of Si and B is 0.6% and 0.3%, respectively, or higher. However, when the content of Si and B is higher than 6.0% and 3.0%, respectively, X-ray tests show the brittleness of the microwire is increased, due to the destruction of the ρ-phase.

At the optimal content of Si and B, that correspond to 0.6–6.0 weight % of Si and 0.3–3.0 weight % of B the microwire of length of higher than 100 m can be obtained.

According to a yet a further embodiment of the invention, the further improvement of the technology for the microwire manufacture providing the increase of the continuous length of the microwire having high tensile strength (more than 4500 MPa) may be attained by means of intensive purification of the alloy and elimination of the gas and other nonmetallic inclusions, e.g., oxygen, hydrogen and nitrogen or their compounds. The purification is especially important, because the obtained microwires have a rather small diameter, ranging from 10 microns up to 150 microns.

For the purpose of the purification the introduction of small amounts of elements having the best affinity to these gases can be used. Special care should be taken in order to preserve the ρ-phase and maintain the complex of the obtained physical-chemical properties and technological advantages.

Examples of the element that has the best affinity to oxygen, hydrogen, and nitrogen include, but are not limited to, Cerium for oxygen, at least one of the rare-earth elements selected from La, Nd, Ce, Pr for oxygen and nitrogen, and Yttrium for hydrogen. It should be noted, these examples of the elements were chosen for reasons of non-toxicity, chemical activity and technological ability.

According to one example, for optimization of the alloy composition the complex introduction of elements is realized, in which the elements are added to the alloy in the following content, by weight %:

at least one element selected from Ce, La, Nd and Pr: 0.1–1.8%, and

Y: 0.1–1.5%.

When the content of these rare-earth elements is less than that in the above example, the purification effect is not obtained. On the other hand, when the content of these elements is larger than in the above example, these ingredients exude into isolated phases and, as a result, the brittleness of the microwire is increased.

According to further embodiment of the invention, when the Ni-based alloy is used for casting a microwire in aluminum-borosilicate glass insulation, an additional element such as Al is further introduced in the content of the alloy. Preferably, the content of the Al is in the range of 0.6–5.0 weight %. Such amount provides a rather good wetting of the glass by the metal.

Further, an additional element such as Zr can preferably be further introduced in the content of the alloy. Zr is an effective amorphizer. The applicants have found that for preparation of an amorphous alloy on the base of a transition metal, for example a Ni-based alloy, it is beneficial to introduce some amorphizers. The applicants found that in the presence of amorphizers such as Si and B in alloys containing Ni and Cr, the additional introduction of Zr is an effective method. At an optimal content of Zr that corresponds to 1.2–5.0% an effective amorphization rate may be decreased up to a required level. In this case a larger microwire diameter may be produced. When the content of Zr is higher than 5% this element exudes into isolated phases and brittleness of the microwire is increased. When introducing Zr, Zr is introduced into the melt after Si and B.

Table 1 illustrates several examples of the properties of microwire made from the alloy according to the above embodiments of present invention. Alloys 1, 2 and 3 have optimal compositions of the components, while alloys 4 and 5 have the compositions comprising the components in the range of content smaller or higher than the optimal content.

TABLE 1

| | Composition of the alloy | | | | | | | | | | |
|---|---|---|---|---|---|---|---|---|---|---|---|
| No | Ni | Cr | Mo | Si | B | Zr | Ce (La, Pr, Nd) | Y | $\sigma_B$, MPa | $\acute{\epsilon}$, % | Length of wire, m |
| 1 | balance | 10.0 | 25.0 | 0.6 | 0.3 | 1.2 | 0.1 | 0.1 | 4100–4500 | 2.5–3.2 | 1200–1800 |
| 2 | balance | 40.0 | 32.0 | 2.8 | 1.8 | 2.4 | 0.9 | 0.8 | 4300–4500 | 2.4–3.0 | 1500–2000 |
| 3 | balance | 34.0 | 42.0 | 6.0 | 3.0 | 5.0 | 1.8 | 1.5 | 4200–4500 | 2.2–2.6 | 1800–2100 |
| 4 | balance | 9.9 | 24.9 | 0.5 | 0.2 | 1.1 | 0.09 | 0.09 | 700–900 | 0.8–1.2 | 1–1.5 |
| 5 | balance | 40.1 | 42.1 | 6.1 | 6.1 | 5.1 | 1.9 | 1.6 | 800–1000 | 0.03–0.05 | 80–100 |

According to the invention, the alloy is melted in alundum crucibles by the induction furnace.

According to one embodiment of the invention, the ingredients are added in the following order:

1. Nickel, chromium, molybdenum;
2. Silicon and boron are added in series after melting of the triple system;
3. Zirconium is introduced after silicon and boron.
4. At least one rare-earth element selected from Ce, La, Nd, Pr and Y is introduced.

A glass-coated microwire with an amorphous metal core is produced by providing a glass tube containing the desired metal and melting the metal in a high frequency induction field. The heat of the metal melt softens the glass tube and a thin capillary is drawn out from the softened glass tube. Thereafter, the metal-filled capillary enters a cooling zone where it is rapidly cooled such that the desired amorphous microwire is obtained. The optimal diameters of the obtained microwire is in the range of 10 to 150μ. When the rate of the casting is decreased, microwires having a diameter higher than 200μ can also be obtained.

Referring to FIG. 1, a system for a mass manufacture of continuous lengths of glass coated microwire is shown in schematic form in order to illustrate the process according to one embodiment of the invention. It should be noted that the blocks in FIG. 1 are intended as functional entities only, such that the functional relationships between the entities are shown, rather than any physical connections and/or physical relationships. The system of FIG. 1, generally identified by reference numeral 10, includes a suitable glass feeder mechanism diagrammatically represented by a circle 101 for providing a supply of a glass tubing 102. The system also includes a rod feeder mechanism diagrammatically represented by a circle 103 for providing a supply of a rod, bar or wire 104 made of a core material. It should be appreciated that the mechanisms 101 and 103 can be both configured in one feeder device that may serve a multiple function for providing a supply of glass and core materials. The glass feeder mechanism 101 is controllable by a glass feeder signal and includes a driving motor (not shown) which acts on the glass tubing 102 for providing a supply of a glass material with a required speed. By the same token, the rod feeder mechanism 103 is controllable by a rod feeder signal and includes a driving motor (not shown) which acts on the rod 104 for providing a supply of a core material with a required speed. The glass and rod feeder signals are generated by a controller 109 configured to control the system 10.

Examples of the glasses of the glass tubing 102 include, but are not limited to, glasses with a large amount of oxides of alkali metals, borosilicate glasses, aluminosilicate glasses, etc. It should be understood that various alternative glasses may be selected by one skilled in the art for the particular desired application and environment in which the coated wire composite is to be used. Pyrex glass, Soda glass and Quartz glass are the most common.

A tip of the glass tubing 102 loaded with the rod 104 is introduced into a furnace 106 adapted for softening the glass material making up the tubing 102 and melting the rod 104 in the vicinity of the exit orifice 107, such that a drop 105 of the wire material in the molten state is formed.

According to one embodiment of the invention, the furnace 106 includes at least one high frequency induction coil, e.g. one wind coil. The operation of the furnace 106 is known per se, and will not be expounded in details below.

An exemplary furnace that has been shown to be suitable for the manufacturing process of the present invention is the Model HFP 12, manufactured by EFD Induction Gmbh, Germany.

The temperature of the drop is measured by a temperature sensor pointing at the hottest point of the drop and diagrammatically represented by a box 108. An example of the temperature sensor includes, but is not limited to, the Model Omega OS1553-A produced by Omega Engineering Ltd.

The temperature sensor 108 is operable for producing a temperature sensor signal. The temperature sensor 108 is coupled to the controller 109 which is, inter alia, responsive to the temperature sensor signal and capable of providing a control by means of a PID loop for regulating the temperature of the drop 105 for stabilizing and maintaining it at a required magnitude. For example, the temperature of the drop can be maintained in the range of 800° C. to 1500° C.

It should be appreciated that one way of regulating the drop temperature is the regulation of the temperature of the furnace 106 by changing the furnace's power consumption. For this purpose, controller 109 is capable of generating a furnace power signal, by means of a PID control loop, to a power supply unit 113 of the furnace 106. For example, when the consumption power increases, the drop temperature should also increase, provided by the condition that the position of the drop 105 does not change with respect to the furnace 106. However, since the furnace includes a high frequency induction coil, the increase of the consumption power leads to the elevation of the drop, due to the levitation effect. Hence, the temperature of the drop depends on many parameters and does not always change in the desired direction when only the consumption power is regulated.

An example of the power supply unit 113 includes, but is not limited to the Mitsubishi AC inverter, Model FR-A540–11k-EC, Mitsubishi, Japan.

According to one embodiment of the invention, the compensation of the levitation effect is accomplished by the regulation of the gas pressure in the tubing 102. Thus, in order to avoid the droplet elevation due to the increase of the consumption power, the negative gas pressure (with respect to the atmospheric pressure) is decreased to a required value calculated by the controller 109.

For this purpose, the system 10 is further provided with a vacuum device identified by reference numeral 120 for evacuating gas from the tubing 102. The vacuum device 120 is coupled to the tubing 102 via a suitable sealable coupling element (not shown) so as to apply negative gas pressure to the inside volume of the tube 102 while allowing passage of the rod 104 therethrough.

The vacuum device 120 is controllable by a vacuum device signal generated by the controller 109 for providing variable negative pressure to the molten metal drop in the region of contact with the glass. The pressure variation permits the manipulation and control of the molten metal in the interface with the glass in a manner as may be suitable to provide a desirable result.

The system 10 is further provided with a cooling device 110, arranged downstream of the furnace 106 and adapted for cooling a microwire filament 111 drawn out from the drop 105. The microwire filament 111 can be drawn at a speed in the range of 5 m/min to 1500 m/min through the cooling device 110. The cooling device 110 is built in such a way that the filament 111 being formed passes though a cooling liquid where it supercools and solidifies, and thereafter proceeds as a microwire 112 towards a receiver section 130 arranged downstream of the cooling device 110.

The receiver section 130 includes a spooler 138 for collecting the finished microwire product. The spooler 138 includes at least one receiving spool 141, a spool diameter sensor 142, a drive motor assembly 143, and a guide pulley assembly 144. The spool diameter sensor 142 is configured to measure an effective core diameter of the spool and to generate a spool diameter sensor signal representative of the value of the spool diameter.

The drive motor assembly 143 is controllable by a spool speed signal generated by the controller 109 for rotating the spool with a required cyclic speed in response to the spool diameter sensor signal. The cyclic speed is regulated to maintain the linear speed of the microwire at the desired value.

The receiver section 130 can further include a tension unit 131 having a tension sensor 145 configured to generate a tension sensor signal.

The tension unit 131 also includes a tension generator 146 controllable by a wire tension signal produced by the controller 109 in response to the tension sensor signal. The tension generator 146 is arranged to create tension of the microwire.

The receiver section 130 can also include a wax applicator 136 for waxing the microwire. The system 10 can also include a micrometer 135 arranged downstream of the tension unit 131 and configured to measure the microwire overall diameter, length, and other parameters, e.g., a microwire speed. The micrometer 135 is configured to produce, inter alia, a wire diameter sensor signal representative of the microwire overall diameter. The micrometer 135 is operatively coupled to the controller 109 that is responsive to the diameter sensor signal and is operable to generate a corresponding signal for regulating, inter alia, the drop temperature, to stabilize the overall microwire diameter.

The receiver section 130 also includes a required number of guide pulleys 132 arranged to provide a required direction to the microwire.

As such, those skilled in the art to which the present invention pertains, can appreciate that while the present invention has been described in terms of preferred embodiments, the concept upon which this disclosure is based may readily be utilized as a basis for the designing of other structures, systems and processes for carrying out the several purposes of the present invention.

It should be apparent that the alloy in accordance with the present invention may be equally well-suited for use in the manufacture of a wide variety of coated wire composites and is not necessarily limited to the manufacture of the particular examples described herein.

Although the system for production of wire shaped materials have been described above, it should also be understood that the alloy of the present invention can be used for preparation of thin ribbons by using known fabrication apparatuses.

Also, it is to be understood that the phraseology and terminology employed herein are for the purpose of description and should not be regarded as limiting.

It is important, therefore, that the scope of the invention is not construed as being limited by the illustrative embodiments and examples set forth herein. Other variations are possible within the scope of the present invention as defined in the appended claims and their equivalents.

The invention claimed is:

1. A substantially amorphous alloy comprising, in weight %, 10.0 to 40.0% of Cr, 25.0 to 42.0% of Mo, 0.6 to 6.0% of Si, 0.3 to 3.0% of B, 1.2 to 5.0% of Zr, 0.1 to 1.8% of at least one element selected from the group consisting of Ce, La, Nd and Pr, 0.1 to 1.5% of Y, and a balance of Ni.

2. The alloy according to claim 1, wherein a ratio of Si:B=2:1.

3. The alloy according to claim 2, further comprising 0.6 to 5.0 weight % of Al.

4. A method of using an alloy, the method comprising casting a microwire comprising a core and an aluminum-borosilicate glass insulation coated on the core, wherein the core comprises the alloy of claim 3.

5. A method of using an alloy, the method comprising casting a microwire comprising a core and a glass insulation coated on the core, wherein the core comprises the alloy of claim 1.

6. A method of making an alloy, the method comprising melting together Cr, Mo, Si, B, Zr, Y, Ni and at least one element selected from the group consisting of Ce, La, Nd and Pr; and producing the alloy of claim 1.

* * * * *